United States Patent [19]

Mayland

[11] 4,432,418

[45] Feb. 21, 1984

[54] APPARATUS FOR RELEASABLY BRIDGING A WELL

[76] Inventor: Harold E. Mayland, 2467 S. Granby Way, Aurora, Colo. 80014

[21] Appl. No.: 319,440

[22] Filed: Nov. 9, 1981

[51] Int. Cl.[3] ..... E21B 33/128; E21B 33/129

[52] U.S. Cl. ..... 166/133; 166/135; 166/217; 166/184; 166/123

[58] Field of Search ..... 166/131, 133, 126, 123, 166/217, 184, 185, 135, 182

[56] References Cited

U.S. PATENT DOCUMENTS

| | | | |
|---|---|---|---|
| 2,084,611 | 6/1937 | Crickmer | 166/131 |
| 2,217,986 | 10/1940 | Knox | 166/13 |
| 2,230,712 | 2/1941 | Bendeler et al. | 166/13 |
| 2,338,326 | 1/1944 | Green | 166/126 |
| 2,577,068 | 12/1951 | Baker | 166/131 |
| 2,725,941 | 12/1955 | Henshaw | 166/184 |
| 3,285,343 | 11/1966 | Urbansky | 166/134 |
| 3,420,304 | 1/1969 | Kilgore | 166/114 |
| 3,460,624 | 8/1969 | Aitken et al. | 166/285 |
| 3,460,625 | 8/1969 | Hart et al. | 166/285 |
| 3,542,128 | 11/1970 | Owen | 166/123 |
| 3,976,133 | 8/1976 | Allen | 166/120 |
| 4,099,563 | 6/1978 | Hutchison et al. | 166/317 X |

*Primary Examiner*—William F. Pate, III
*Assistant Examiner*—Michael Starinsky
*Attorney, Agent, or Firm*—John E. Reilly

[57] ABSTRACT

A novel and improved method and means have been devised for releasably bridging or isolating formations in a well. The apparatus consists of a retrievable bridge plug which can be run down into a well to the desired setting depth and a packer assembly on the plug can then be activated to set the apparatus in position. After work has been performed, a retrieving tool is run into the well in order to engage the bridge plug for its removal. If sand or other foreign matter is present on top of the plug, a circulating medium may be employed to remove the foreign matter even as the retrieving tool is being lowered into engagement with the plug. The plug is designed such that pressure can be equalized on opposite sides of the plug as a preliminary to removal from the well by the retrieving tool.

20 Claims, 6 Drawing Figures

APPARATUS FOR RELEASABLY BRIDGING A WELL

This invention relates to a retrievable bridge plug for well casing, and more particularly relates to a novel and improved method and apparatus adaptable for use in bridging off a well to prevent movement of fluids from the point at which it is set, such as for example, to seal off a particular zone or section of a well bore.

BACKGROUND AND FIELD OF THE INVENTION

Various devices have been employed for the purpose of forming a bridge or plug in a well bore, whether cased or open hole, to isolate selected areas or strata in a formation. For example, when a particular oil formation ceases to be productive or produces an excessive amount of water or gas, it is desirable to seal off that formation while continuing recovery operations through other formations or strata. Representative of approaches taken in the past is disclosed in U.S. Pat. No. 3,285,343 to Urbanosky in which a permanently set bridge plug has resilient restraining elements which encircle a slip assembly to control the outward movement of the slips. A similar approach is disclosed in U.S. Pat. No. 3,542,128 to Owen. However, in Owen a retrievable bridge plug employs cammed latching members in combination with a packer assembly in which the latch members must be first released to equalize the pressure on opposite sides of the apparatus as a preliminary to its retrieval. U.S. Pat. No. 2,217,986 to Knox also discloses a retrievable bridge plug which can be lowered into position by a wireline or cable and employs latching elements to control the locking and release of slips which are positioned over a conical member. Similarly, U.S. Pat. No. 2,230,712 to Bendeler et al discloses the use of a retrievable bridge plug which employs slips in combination with a generally conical member and having latching elements to cause expansion of the slips into engagement with the well casing and subsequent contraction of the slips as a preliminary to retrieval of the plug from the well. U.S. Pat. Nos. 3,460,625 to Hart et al and 3,420,304 to Kilgore together with 3,976,133 to Allen and 3,460,624 to Aitken et al are of general interest for disclosing other approaches to bridging well bores either with retrievable or permanently set bridge plugs. Nevertheless, a frequent occurrence and definite deterrent to reliable operation of retrievable bridge plugs has been the tendency of sand or other debris to accumulate over the bridge plug once set. Previously, bridge plugs of the retrievable type have not been designed to permit circulation of a fluid to remove such sand and debris from above the bridge plug so that the bridge plug is accessible for retrieval and especially in such a way as to be capable of circulating the medium as a preliminary to equalizing the pressure on opposite sides of the plug before the tool is released. Further, it is desirable to provide a slip and packer arrangement which is capable of being positively set and released with respect to a well bore and is conformable for use in different sized bores while permitting remote actuation in a positive reliable manner.

SUMMARY OF INVENTION

It is therefore an object of the present invention to provide for a novel and improved method and apparatus for releasably bridging a zone or zones in a well bore.

It is another object of the present invention to provide for a retrievable bridge plug, specifically adaptable for use as a wireline set bridge plug, which is capable of being positively set and released in a well bore so as to selectively isolate downhole formations.

It is an additional object of the present invention to provide a novel and improved slip and packer assembly which is adaptable for use with a retrievable bridge plug in isolating zones, formation fracturing or acidizing and other well treating or producing operations.

It is still a further object of the present invention to provide for a novel and improved method and means for releasably setting a bridge plug in such a way that sand or other debris which tends to accumulate above the plug may be efficiently removed prior to equalization of the pressure on opposite sides of the plug and as a preliminary to its retrieval from the well bore.

In accordance with the present invention, a preferred form of retrievable bridge plug resides in the cooperative disposition and relation between an inner mandrel which extends the substantial length of the plug and terminates at its lower end in a lower slip expansion portion and a support tube which is arranged in outer concentric relation to the mandrel including means releasably connecting the support tube and mandrel with a packer and slip assembly disposed on the outer support tube. The slip assembly is engageable with the slip expander portion when the outer support tube is caused to move downwardly with respect to the mandrel. The bridge plug is formed with pressure equalizing means including a passageway which establishes communication above and below the packer assembly but is normally closed by a separable portion in the outer tube which is located directly above the expanded packer assembly. Once in position with the packer assembly expanded against the wall of the bore, any desired well treating operations may be carried out, such as, fracturing or acidizing as well as production from a selected zone. After such operations have been performed and it is desired to remove the bridge plug, a retrieval tool is lowered into the well bore to engage retrieval lugs on the outer support tube. If sand or other debris has collected around the upper end of the plug making it difficult to effect an engagement with the upper end of the plug by the retrieval tool, a circulating medium is injected into the well bore to remove any sand or debris while maintaining a complete seal at the packer assembly. Thereafter, the retrieval tool can be moved into engagement with the retrieval lugs to apply an upwardly directed force to the outer support tube which will axially separate the tube at its juncture with the passageway while leaving the packer in expanded relation to the well bore. As a result, pressure in the formations are equalized above and below the packer assembly as a preliminary to continued upward application of force to release a latch member so as to contract the packer assembly and permit removal of the entire plug from the well bore.

The above and other objects, advantages and features of the present invention will become more readily appreciated and understood from a consideration of the following detailed description of a preferred embodiment of the present invention when taken together with the accompanying drawings of a preferred embodiment of the present invention, in which:

DETAILED DESCRIPTION OF THE PREFERRED EMBODIMENT

Figure 1:
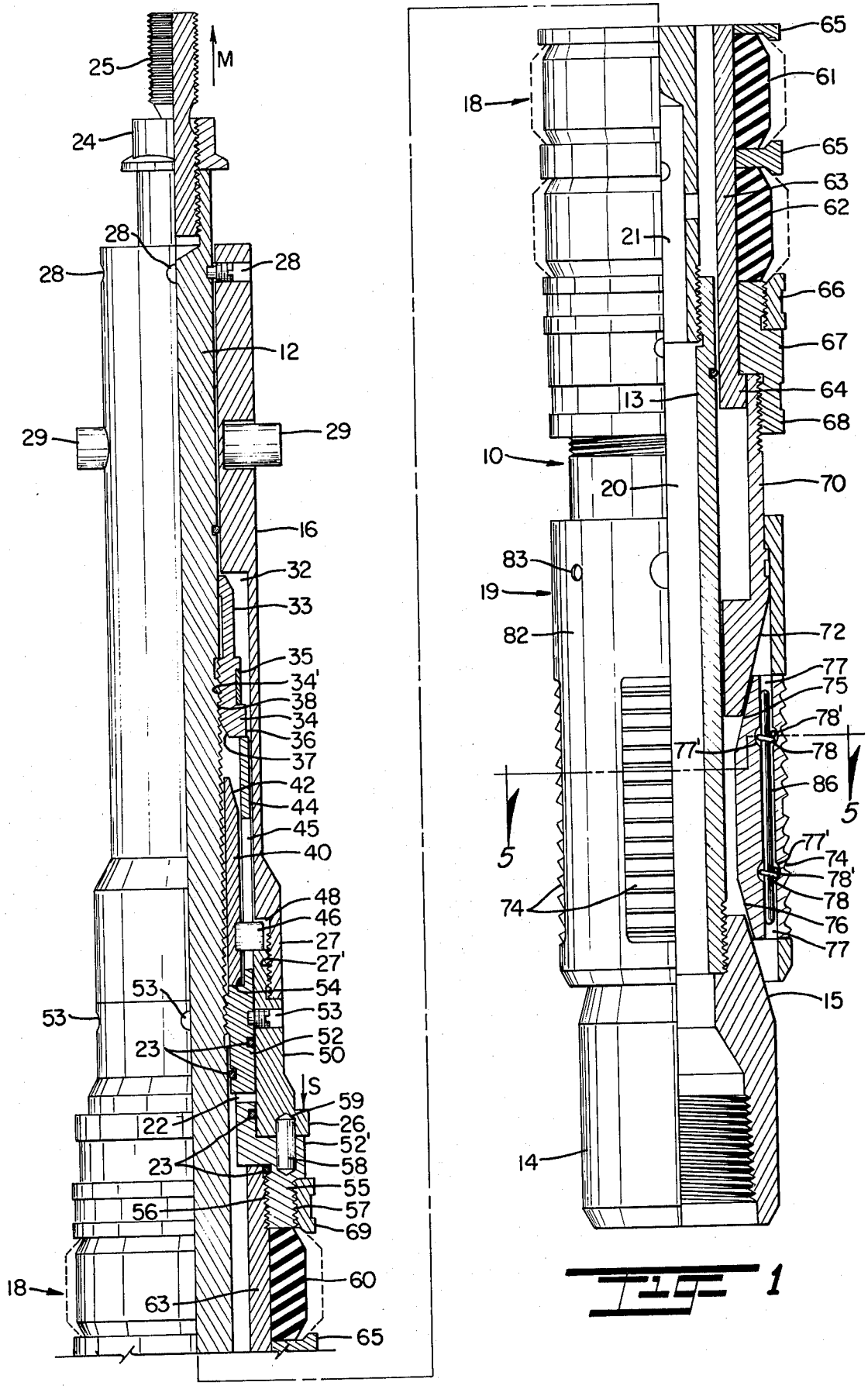
FIG. 1 is a longitudinal sectional view of a preferred form of apparatus illustrating the relationship between parts in the run-in position as it is lowered into a well in accordance with the present invention.
Figure 2:
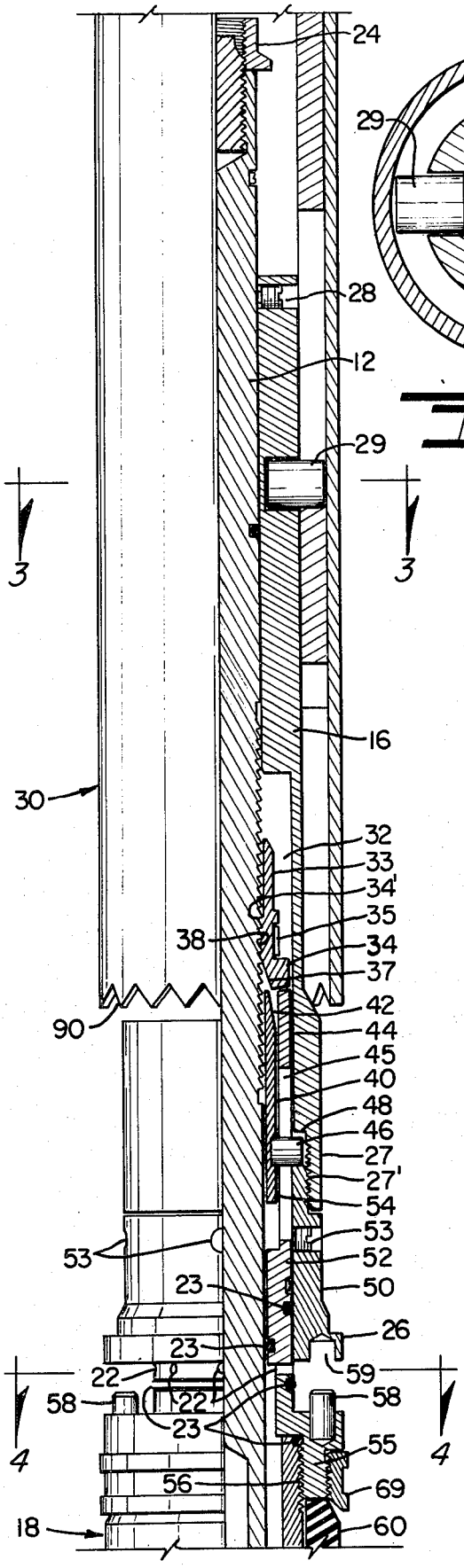
FIG. 2 is a longitudinal sectional view of the preferred form of invention showing the relationship between parts in the released position.
Figure 3:
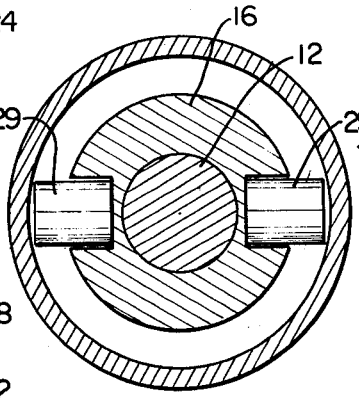
FIG. 3 is a cross-sectional view taken about lines 3—3 of FIG. 2.

Referring in detail to the drawings, there is illustrated in FIG. 1 the run-in position of the preferred form of retrievable bridge plug 10, and FIG. 2 illustrates the relationship between parts in the released position of the preferred form of bridge plug. Broadly, the bridge plug 10 is comprised of an inner mandrel which is made up of an upper solid mandrel section 12 and a lower hollow mandrel section 13 having a sub 14 at its lower extremity provided with an outer, generally conical slip actuating surface 15. An outer, generally tubular support 16 is assembled in outer concentric relation to the upper mandrel section 12, and a packer assembly 18 and slip assembly 19 are assembled in outer concentric relation to the lower mandrel section 13. An annular passageway 20 extends between the packer assembly 18 and lower end of the upper mandrel section 12 to establish communication through a counterbored portion 21 at the lower end of the mandrel section 12 and hollow interior of the lower mandrel section 13 as well as the sub 14 with the well bore beneath the packer assembly, and the upper end of the passageway 20 communicates with normally closed ports 22 at the lower end of the tubular support 16.

The preferred form of retrievable bridge plug is intended for use with a conventional form of wireline setting tool, such as, a Model E-4 manufactured and sold by Baker Service Tools of 6023 Navigation Boulevard, Houston, Texas 77001. To this end, the upper end of the mandrel section 12 is provided with a flanged housing nut 24 and a shear stud 25 threadedly engages the interior of the housing nut, the shear stud 25 being adapted for threaded engagement with a tension mandrel, not shown, forming a part of the wireline tool. In turn, an equalizer body 50 at the lower end of the tubular support 16 is provided with an enlarged end or shoulder 26 for engagement by a standard form of setting sleeve which forms a part of the wireline tool. As a preliminary to a more detailed description of the present invention, it is important to recognize that the assembly and interconnection between the inner mandrel 12 and outer tubular support 16 permits the application of force by the tension mandrel in an upward direction, as designated by the arrow M, and a simultaneous downward force by the setting sleeve against the shoulder 26 in the direction of the arrow S.

Figure 6:
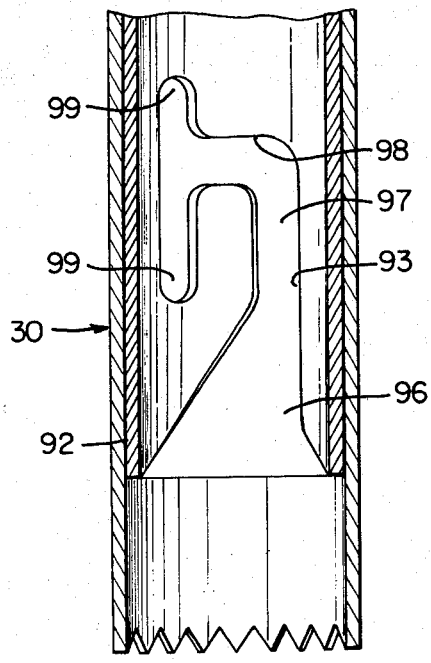
FIG. 6 is a somewhat fragmentary, longitudinal sectional view of a retrieval tool employed in the removal of the preferred form of invention from a well bore.

In assembled relation, the outer tubular support 16 is releasably interconnected to the inner mandrel by upper shear screws 28 which extend radially inwardly through the wall of the tubular support 16 into an aligned bore of limited depth formed in the external surface of the upper end of the upper mandrel section 12. Release pins or retrieval lugs 29 are disposed in diametrically opposed relation to one another in the wall of the tubular support beneath the upper shear screws 28 and project radially outwardly from the surface of the tubular support for engagement by a retrieval tool 30 as illustrated in FIG. 6 and to be hereinafter described in more detail. The tubular support is decreased in thickness in that section below the lugs 29 to form an annular cavity or space 32 for the purpose of housing a releasable latch ring 33 which is disposed in surrounding relation to the upper mandrel section and is provided with a lower, internally threaded end 34 of increased thickness such that the internally threaded surface 34' of the end 34 is engageable with complementary threading 38 on the mandrel. A resilient band or spring 35 encircles the ring 33 to releasably retain the ring 33 against the mandrel, and the lower extremity of the end 34 has a shoulder 36 which projects radially outwardly into close proximity to the inner wall of the cavity 32 and has a lower beveled end 37 directly beneath the internally threaded surface 34'.

A release ring 40 is disposed in the cavity in normally spaced relation below the latch ring 33, the release ring 40 being of uniform thickness throughout except for a generally conical or beveled end surface 42 at its upper end. A sleeve or collet 44 is inserted concentrically between the release ring 40 and inner wall of the lower end of the tubular support 16, the sleeve provided with circumferentially spaced, open slots 45 directed downwardly at circumferentially spaced intervals corresponding to the spacing of a plurality of limit stops 46, the latter projecting radially outwardly from the external wall of the release ring 40 into a recessed area 48 at the lower extremity 27 of the tubular support. The lower extremity 27 is internally threaded as at 27' for threaded connection of the equalizer body 50 wich forms a downward continuation of the lower end of the tubular support 16. The equalizer body 50 is releasably interconnected by lower shear screws 53 to the connector body 52 which threadedly engages the upper mandrel section 12 at the lower end of the externally threaded mandrel surface 38. The upper end of the connector body 52 is recessed as at 54 to permit limited insertion of the lower end of the release ring 40. A lower extension of the connector body is represented at 52' and projects in a radially outward direction then downwardly as at 55 with internally and externally threaded surfaces 56 and 57, respectively, the internal threaded surface 56 being connected to the upper end of the packer assembly 18. The shoulder 26 at the lower extremity of the equalizer sleeve or body 50 is rotationally locked with respect to the extension 54 of the connector body by circumferentially spaced, axially directed pins 58 which project upwardly from the extension 54 for slidable insertion into aligned counterbored portions 59 in the equalizer body 50. The ports 22 are formed by radial bores at circumferentially spaced intervals in the connector body 52; and O-rings 23 are arranged as shown between the connector sleeve 52, equalizer sleeve 50 and inner mandrel above and below the ports 22 as shown.

In the packer assembly 18, a plurality of vertically spaced, elastomeric packing elements 60, 61 and 62 are arranged in surrounding relation to a common support sleeve 63, the upper end of which is threadedly secured to a lower end of the connector body 56 as described; and the lower end of the support sleeve 63 is disposed in surrounding relation to the upper end of the lower mandrel section 13 and has an external shoulder 64. The packing elements 60–62 are separated by axially slidable, intermediate retaining rings 65, and a lower retaining ring 66 is threadedly connected to the upper end of a collar 67 which is supported on the external shoulder portion 64 of the support sleeve. The collar 67 has a lower threaded extension 68 for a purpose to be described. An upper stationary retaining ring 69 is threadedly secured to the lower extension 55 of the connector body 54 to complete the assembly of the packer. Each of the retainer rings 69, 65 and 66 is provided with an enlarged external end which, upon compression of the packing elements in a manner to be described, will cause the packing elements to be forced outwardly into the expanded positions as shown dotted in FIG. 1.

Figure 5:
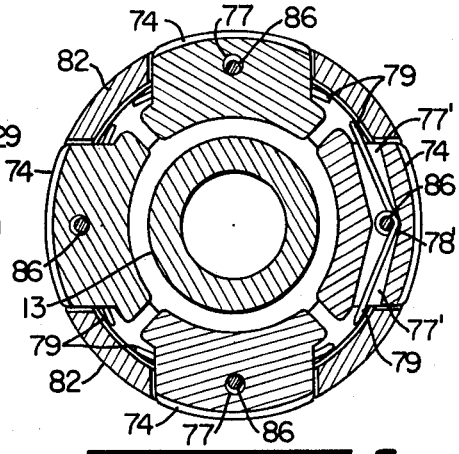
FIG. 5 is a cross-sectional view taken about lines 5—5 of FIG. 1.
Figure 4:
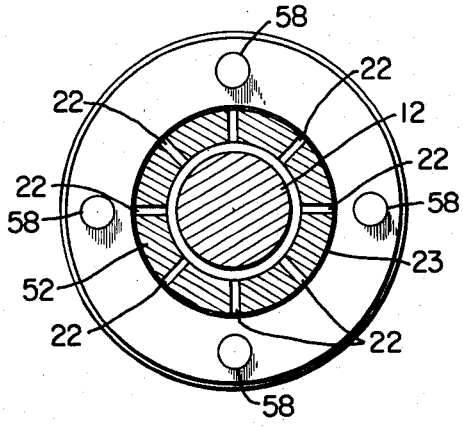
FIG. 4 is a cross-sectional view of a preferred form of the present invention taken about lines 4—4 of FIG. 2.

The packer assembly as described is preferably employed in cooperation with the slip assembly 19 and, to this end, the lower extension 68 of the collar 67 is threadedly secured to an upper shoe 70 of the slip assembly. Here, the shoe has an upwardly directed annular extension insertable between the external shoulder 64 and extension 68 for threaded engagement with the extension 68, the shoe including a lower conical end 72 which has its inner surface bearing against the external wall of the lower mandrel 13 and its external tapered surface disposed beneath each of a series of circumferentially spaced slip segments 74. The slip segments 74 are formed with oppositely directed, upper and lower tapered end surfaces 75 and 76, respectively, which are complementary to the upper conical end surface 72 and the conical surface 15 of the lower sub 14. Each of the slip segments has a vertical bore 77 to receive upper and lower spring elements 78. Each spring is of the hairpin or clutch type with a central coiled portion 78' disposed in the bore 77 and laterally extending ends 79 which project through lateral bores 77' communicating with the bore 77, as shown in FIG. 5. Each slip segment 74 protrudes through one of a series of circumferentially spaced openings 81 in the wall of a cylindrical member 82 which is releasably interconnected by shear screws 83 to the external wall of the shoe 70 as shown. Each spring 78 is secured in the vertical bore 77 by a rod 86, and the lateral ends 78' project behind the wall of the cylindrical member 82, as shown in FIG. 5, to bias each slip segment 74 in an inward radial direction through the window.

Specifically referring to FIG. 1, the bridge plug as shown in its assembled relation for lowering to the desired depth through a well conduit or casing string, not shown, but which, for example, may be lowered by means of a wireline and hydraulic setting tool as described. When the assembly is lowered to the required depth, for example, to isolate selected zones in a well, the setting tool is activated so as to apply an upward pulling force on the shear stud 25 while exerting a downward force on the shoulder 26 sufficient to sever the shear screws 28 and initiate downward movement of the outer tubular support member 16. Downward movement of the tubular support 16 will cause the packer assembly 18 and slip assembly 19 to move downwardly relative to the lower conical end 14. Expansion of the slip segments 74 along the conical end surface 15 will continue until the slip segments are moved into engagement with the casing wall. At that time, the slip cylinder 82 will be urged in an upward direction until the shear screws 83 are severed whereupon the cylinder will move independently of the shoe 70 into engagement with the lower extension 68 whereby to cause compression of the packing elements 60–62 between the slip assembly 19 and connector body 55 until the packing elements are expanded into engagement with the wall conduit or well bore as the case may be. In this position of the bridge plug, it will be noted that the passageway 20 remains closed by virtue of the sealed relationship of the equalizer body 50 over the ports 22 so that the desired well treating operations as well as other operations may be conducted.

After the desired operations have been completed and the bridge plug is to be retrieved from the hole, the retrieval tool 30 is lowered into the well bore for movement into engagement with the release pins or lugs 29 at the upper end of the support tube 16. In the process of lowering the setting tool through the well bore, sand and debris is often encountered making it difficult, if not impossible, to effect engagement with the retrieval lugs 29 in a manner to be described. The bridge plug of the present invention permits circulation of a fluid under pressure into the well bore to remove any sand, debris or other foreign matter as a preliminary to release of the bridge plug and without first equalizing the pressure on opposite sides of the bridge plug. Once the sand or debris has been removed, the setting tool then can be lowered to the necessary depth to effect engagement with the diametrically opposed lugs 29. In this connection, the retrieval tool as illustrated is of tubular construction as shown having lower serrated or saw-tooth edges 90 and an inner sleeve portion 92 permanently affixed within the outer tube and provided with diametrically opposed slotted portions 93 of inverted, generally J-shaped configuration. Thus, each slot as shown in FIG. 5 comprises a divergent entrance portion 96 which narrows upwardly as at 97 and verges into a circumferentially extending slotted portion 98 and intersects an axially directed, closed slotted end 99. When the setting tool is inserted over the retrieval lugs as illustrated in FIG. 2, the lugs 29 are caused to enter through the entrance areas 96 until they have reached the upper ends of the slotted portions 97. Then the setting tool 30 is rotated to cause the slots to advance through the slotted portions 98, and finally upon lifting the setting tool the slotted ends 99 will advance upwardly with respect to the lugs sufficient to cause them to be lodged firmly in the lower extremities of the slotted portions 99. Application of continued upward force on the setting tool will cause the shear screws 53 to be severed and permit the equalizer body 50 to advance from the closed position shown in FIG. 1 to the open position shown in FIG. 2 and specifically to open the ports 22 for equalization of pressure above and below the packer assembly by permitting free flow of fluid between the zones. As the pressure is being equalized, continued upward application of force on the outer tubular support will cause the release cone 40 to advance upwardly into engagement with the lock ring 33 and to exert sufficient force to contract the packer assembly and permit release of the entire plug assembly from the well.

As the release ring 40 moves into engagement with the ring 33, it will overcome the contracting force of the spring 35 to urge the ring 34 away from threaded engagement with the mandrel to permit the mandrel to be lowered with respect to the support tube and remove the pressure of the slip actuator cone 15 against the slip segments 19. At the same time, the upward force applied to the support tube 16 will be sufficient to cause the packers 60–62 to expand or lengthen in an axial direction and be contracted away from the well conduit to free the entire assembly for removal from the well conduit.

It is therefore to be understood that various modifications and changes in the construction and arrangement of parts and sequence of steps employed in the preferred form of invention may be made without departing from the spirit and scope of the present invention as defined by the appended claims.

I claim:

1. A retrievable bridge plug for isolating zones in a well conduit comprising in combination:

an inner mandrel having an upper section with no passageway therethrough;

a support tube disposed in outer concentric relation to said inner mandrel having radial expansion means operative to be expanded into anchored relation to a well conduit;

means releasably interconnecting said inner mandrel and support tube being operative when a downwardly directed force is applied to said outer tube with respect to said inner mandrel to release said support tube from said inner mandrel, and means responsive to release of said support tube to cause expansion of said radial expansion means into engagement with said well conduit; and pressure equalizing means including a passageway within said bridge plug below said upper solid section of said mandrel to establish communication between the zones in said well conduit above and below said radial expansion means, said pressure equalizing means including releasable closure means normally closing said passageway to isolate said zones from one another and operative upon application of an upwardly directed force to said support tube with respect to said inner mandrel to open said passageway to establish communication between said zones and thereby to equalize the pressure above and below said radial expansion means in said well conduit.

2. A retrievable bridge plug according to claim 1, said releasable closure means for said pressure equalizing means including a normally closed port in said outer support tube.

3. A retrievable bridge plug according to claim 1, said passageway extending between said inner mandrel and said outer support tube.

4. A retrievable bridge plug according to claim 1, said releasable interconnecting means having a shearable fastener element extending between and releasably interconnecting said inner mandrel and said outer support tube.

5. A retrievable bridge plug according to claim 1, said radial expansion means including a packer assembly on said outer support tube.

6. A retrievable bridge plug according to claim 5, said radial expansion means including slips arranged on said outer support tube for engagement with said well conduit when said support tube is advanced in a downward direction with respect to said inner mandrel.

7. A retrievable bridge plug for isolating zones in a well conduit comprising in combination:

an inner mandrel having an upper section with no passageway therethrough, a lower hollow section and a slip actuator assembly at its lower end;

an outer support tube disposed in outer concentric relation to said inner mandrel having radial expansion means operative to be expanded into anchored relation to a well conduit;

means releasably interconnecting said inner mandrel and outer support tube and operative when a downwardly directed force is applied to said outer tube with respect to said inner mandrel to release said outer support tube from said inner mandrel whereby to advance said radial expansion means into engagement with said slip actuator assembly to effect expansion of said radial expansion means into engagement with said well conduit between the zones above and below said radial expansion means; and pressure equalizing means including a passageway within said bridge plug to establish communication between the zones above and below said radial expansion means through said lower hollow section of said mandrel, said pressure equalizing means including means normally closing said passageway and operative upon application of an upwardly directed force to said outer support tube with respect to said inner mandrel to open said passageway whereby to establish communication between and to equalize the pressure in the zones above and below said radial expansion means in said well conduit.

8. A retrievable bridge plug according to claim 7, said passageway extending between said inner mandrel and outer support tube, and said releasable interconnecting means including a shearable fastener element interconnecting said inner mandrel and outer support tube.

9. A retrievable bridge plug according to claim 7, said radial expansion means including a packer assembly on said outer support tube.

10. In a retrievable bridge plug having an expandible packer assembly adapted to be expanded into anchored relation to a well conduit, the improvement comprising:

an inner mandrel extending substantially the length of said plug, said mandrel having a section with no passageway therethrough;

a support tube disposed in outer concentric relation to said inner mandrel including means releasably interconnecting said inner mandrel and said tube; and pressure equalizing means including a passageway establishing communication above and below said packer assembly with said well conduit and including a normally closed port in said support tube, said port being movable to a position opening said passageway when an upwardly directed force is applied to said outer tube and said packer assembly is in the expanded position in said well conduit whereby to equalize the pressure above and below said packer assembly, said normally closed port disposed in said support tube above said packer and defined by an axially separable portion in said support tube which is operative to undergo separation to open said port when an upwardly directed force is applied to said support tube.

11. In a retrievable bridge plug according to claim 10, said releasable interconnecting means defined by a shear pin between said inner mandrel and support tube.

12. In a retrievable bridge plug according to claim 10, including a shear pin extending between said releasable portions of said support tube.

13. In a retrievable bridge plug according to claim 10, including radially expandible slip segments suspended at the lower end of said tubular support, and slip actuating means responsive to upward relative movement of said inner mandrel to said tubular support to expand said slip segments outwardly into engagement with the well conduit.

14. In a retrievable bridge plug according to claim 13, said radially expandible packer interposed between said slip segments and said outer support tube, and means for expanding said packer in a radially outward direction into engagement with the well conduit in response to expansion of said slip segments into engagement with the well conduit and application of a downward force to said support tube.

15. In a retrievable bridge plug according to claim 14, said packer having packer members of generally toroidal configuration and axially slidable spacer rings interposed between said packer members.

16. In a retrievable bridge plug according to claim 10, including a locking ring mounted on said inner mandrel and packer release means movable with said tubular support into engagement with said locking ring in response to upward slidable movement of said tubular support with respect to said inner mandrel whereby to release said packer members from engagement with said well conduit.

17. In a retrievable bridge plug having an expandable slip and packer assembly adapted to be expanded into anchored relation to a well conduit whereby to isolate zones in said well conduit from one another above and below said slip and packer assembly, the improvement comprising:

an inner mandrel extending substantially the length of said plug having a connector sleeve positioned above said packer assembly and a conical slipactuator member at its lower end;

a support tube disposed in outer concentric relation to said inner mandrel including an equalizer sleeve at its lower end in abutment with said connector sleeve and means releasably interconnecting said inner mandrel and said support tube; and pressure equalizing means including a passageway establishing communication above and below said slip and packer assembly with said well conduit including a normally closed port movable to a position opening said passageway when an upwardly directed force is applied to said outer tube with respect to said inner mandrel and said packer is in the expanded position in said well conduit whereby to equalize the pressure above and below said packer.

18. In a retrievable bridge plug according to claim 10, said normally closed port disposed between said equalizer sleeve and said connector sleeve, said equalizer sleeve operative to undergo separation from said connector sleeve to open said port when an upwardly directed force is applied to said support tube.

19. In a retrievable bridge plug according to claim 17, said slip actuator member responsive to upward relative movement of said inner mandrel to said tubular support to expand said slip assembly outwardly into engagement with the well conduit.

20. In a retrievable bridge plug according to claim 17, including a release ring movable with said equalizer sleeve into engagement with a locking ring mounted on said inner mandrel in response to upward slidable movement of said tubular support with respect to said inner mandrel, and limit stop means on said equalizer sleeve to limit the upward movement of said release ring with respect to said lock ring.

* * * * *